US005625988A

United States Patent [19]

Killick

[11] Patent Number: 5,625,988

[45] Date of Patent: May 6, 1997

[54] POST SUPPORT ASSEMBLY HAVING A MOUNTING SOCKET AND A RIGID COLLAR

[76] Inventor: Andrew Killick, 50 Olympus Way, Lyons ACT 2606, Australia

[21] Appl. No.: 335,754

[22] PCT Filed: Mar. 24, 1993

[86] PCT No.: PCT/AU93/00124

§ 371 Date: Nov. 14, 1994

§ 102(e) Date: Nov. 14, 1994

[87] PCT Pub. No.: WO93/20312

PCT Pub. Date: Oct. 14, 1993

[30] Foreign Application Priority Data

Apr. 1, 1992 [AU] Australia ..... PL1707
Dec. 24, 1992 [AU] Australia ..... PL6615

[51] Int. Cl.[6] ..... E01F 9/013; E04H 12/22

[52] U.S. Cl. ..... 52/298; 52/297; 248/156; 404/9

[58] Field of Search ..... 404/6, 9, 10, 11, 404/12, 13; 116/63 R; 40/607, 612; 256/13.1; 248/160; 52/298

[56] References Cited

U.S. PATENT DOCUMENTS

| | | | |
|---|---|---|---|
| 373,240 | 11/1887 | Logan | 52/154 |
| 1,799,314 | 4/1931 | Pfaff . | |
| 1,982,569 | 11/1934 | Byrd | 52/298 |
| 2,210,441 | 8/1940 | Bachman | 52/298 X |
| 2,315,516 | 4/1943 | Gray | 52/298 |
| 3,032,149 | 5/1962 | Manghise . | |
| 3,305,990 | 2/1967 | Hägeby | 248/511 X |
| 3,353,795 | 11/1967 | Müller | 52/298 |
| 3,385,565 | 5/1968 | Cuthbert . | |
| 3,568,452 | 3/1971 | Stifler, Jr. | 405/237 |
| 3,723,045 | 3/1973 | Reese | 362/431 X |
| 4,240,766 | 12/1980 | Smith et al. | 404/10 |
| 4,343,567 | 8/1982 | Sarver et al. | 404/10 |
| 5,054,944 | 10/1991 | Habernig . | |
| 5,054,955 | 10/1991 | Habernig | 404/10 |

FOREIGN PATENT DOCUMENTS

| | | | |
|---|---|---|---|
| 5368086A | 8/1986 | Australia | E04H 12/22 |
| 1124813 | 10/1956 | France . | |
| 2945092 | 5/1981 | Germany | 404/9 |
| 3721115 | 1/1988 | Germany | E01F 9/01 |

*Primary Examiner*—James A. Lisehora
*Attorney, Agent, or Firm*—Michael D. Bednarek; Kilpatrick & Cody

[57] ABSTRACT

A support assembly for a roadside or traffic signpost includes a mounting socket cylinder (13) fixed in the ground for receiving a support post (12) therein. A resilient support means in the form of a pair of O-rings (16) is interposable between the post and the mounting cylinder. A reinforcing collar (15) prevents deformation of adjacent (1 to 11) portions of the mounting cylinder and the post.

12 Claims, 10 Drawing Sheets

POST SUPPORT ASSEMBLY HAVING A MOUNTING SOCKET AND A RIGID COLLAR

TECHNICAL FIELD

This invention relates to a support assembly.

This invention has particular but not exclusive application to a support assembly for releasably supporting a road sign or the like.

BACKGROUND OF THE INVENTION

Signs at the roadside are well known and extensively used to indicate speed limit, directions, potential hazards, the nature of the road ahead as to curves and conditions, and to indicate distances. They are also used to mount roadside reflective indicators.

It is common for such road signs to be supported on a cylindrical galvanised iron pipe which is buried in the ground at the side of the road. For more permanent attachments it is common for the supporting pipe to be embedded in concrete to avoid removal by vandals or accidental displacement in the course of time.

Such arrangements have a number of disadvantages. In particular because both the sign and the mounting arrangements are often damaged or destroyed upon impact by a vehicle, it is common for considerable effort of both labour and resources to be expended by local councils, authorities and the like in repairing damaged road signs. The repair work is also dangerous for the workers due to the proximity of road traffic. The substantially rigid nature of the connection frequently means that the support post for the sign has to be dug out and then repositioned. Alternatively it is necessary that the damaged sign be cut away from the mounting and a replacement sign welded in place.

Solidly mounted signs cause damage to vehicles as well as personal injury. Attempts have been made to overcome these effects by mounting the road signs on a spring so that upon impact the spring mounting enables the road sign to resiliently flex. It has also been proposed to minimise the damage to a vehicle impacting the roadsign by constructing the post supporting the roadsign from light gauge material. However such an arrangement still requires considerable time and effort to replace when destroyed.

SUMMARY OF INVENTION

The present invention aims to provide a support assembly which will be reliable and efficient in use.

This invention in one aspect resides broadly in a support assembly for supporting a traffic post or the like in the ground, the support assembly including:

a mounting socket for location in the ground and dimensioned to receive the lower end of a post therein; a rigid collar assembly in the form of a stepped sleeve having a socket-engaging reaction face dimensioned to be accommodated in a close tolerance fit by the upper portion of the mounting socket so as to be removably supported thereon and located against lateral movement thereby, and a post-engaging abutment face dimensioned to accommodate a post to be supported by the support assembly in a close tolerance fit, and the arrangement being such that upon application to a post supported by the support assembly of a substantially transverse load sufficient to bend the post, the rigid collar assembly is not deformed and the close tolerance fits prevent substantial deformation of that portion of the post received within the mounting socket, whereby the post and the collar assembly remain removable from the mounting socket.

The mounting socket can be formed in a concrete pad or the like. However it is preferred that the mounting socket is a hollow pipe. Suitably the mounting socket is a hollow cylindrical pipe. The pipe is preferably a steel pipe but in some embodiments a plastic pipe can be used. The pipe may include exterior protrusions for fixing the pipe against rotation when embedded in the ground or set in a concrete pad.

It is preferred that the stepped sleeve is a stepped cylindrical sleeve. Preferably the stepped cylindrical sleeve has internal cylindrical surfaces constituting the abutment face and the reaction face, the surfaces having diameters slightly greater than the outer diameters of the mounting socket and the post respectively to constitute the close tolerance fits.

In another embodiment the stepped cylindrical sleeve has an external cylindrical surface constituting the abutment face and an internal cylindrical surface constituting the reaction face, the surfaces having diameters slightly less than and greater than the inner diameter of the mounting socket and the outer diameter of the post respectively to constitute the close tolerance fits.

Suitably the collar assembly includes retention means adapted to releasably secure the collar assembly to the mounting socket and/or the post.

The mounting socket may include passage means extending from the exterior of the mounting socket to the interior thereof, and receiving means associated with the post for receiving therein the interior passage means whereby the post may extend into the mounting socket and be restrained against rotational movement relative thereto. Preferably the passage means is a conduit adapted to receive electrical cables therethrough. The conduit can have an elbow bend in the interior of the mounting socket, the receiving means being a slot extending longitudinally from the lower end of the post and adapted to pass over the conduit when the post is inserted in the mounting socket.

It is preferred that the support assembly includes locating means for locating the post co-axially in the mounting socket. The locating means may be an annular flange or disc located in the lower portion of the mounting socket so that a post when located within the mounting socket is supported co-axially within the socket. However it is preferred that the locating means comprises resilient support means interposable between the post and the mounting socket for releasably supporting the post.

The resilient support means may be located in the base of the mounting socket, or alternatively the resilient support means may be adapted to be longitudinally spaced along the post when the post is received by the mounting socket. The resilient support means may be a sleeve like member adapted to be positioned on the mounting means or the post. However it is preferred that the resilient support means includes at least one O-ring adapted to be sealingly engaged between the mounting socket and the post.

The support assembly may also include weakening means for inducing the post to crumple in a selected position remote from the mounting means. Suitably the weakening means could be a groove or other indentation for controlling fracture or buckling in the post at a location above the mounting means upon impact.

In another aspect this invention resides broadly in a traffic post or like assembly including:

a post;

a mounting socket for location in the ground and dimensioned to the lower end of the post therein;

a rigid collar assembly in the form of a stepped sleeve having a socket-engaging reaction fact dimensioned to be accommodated in a close tolerance fit by the upper portion of the mounting socket so as to be removably supported thereon and located against lateral movement thereby, and a post-engaging abutment fact dimensioned to accommodate the post in a close tolerance fit; and the arrangement being such that in use, upon application to the post of a substantially transverse load sufficient to bend the post, the rigid collar assembly is not deformed and the close tolerance fits prevent substantial deformation of that portion of the post received within the mounting socket, whereby the post and the collar assembly remain removable from the mounting socket.

In a further aspect this invention residues broadly in a method of mounting a post relative to the ground, the method including:

fixedly positioning relative to the ground mounting socket adapted to receive the post;

providing a collar assembly for supporting the post, the collar assembly being locatable against lateral movement by the mounting socket and having an internal reaction face adapted to closely accommodate the post;

positioning the collar assembly about the lower end of the post;

inserting the post within the mounting socket, and locating the collar assembly adjacent an upper end of the mounting socket.

It is preferred that locating means for locating the post co-axially in the mounting socket are positioned about the lower end of the post.

DESCRIPTION OF DRAWINGS

In order that this invention may be more easily understood and put into practical effect, reference will now be made to the accompanying drawings which illustrate a preferred embodiment of the invention wherein.

DETAILED DESCRIPTION OF PREFERRED EMBODIMENT

Figure 1:
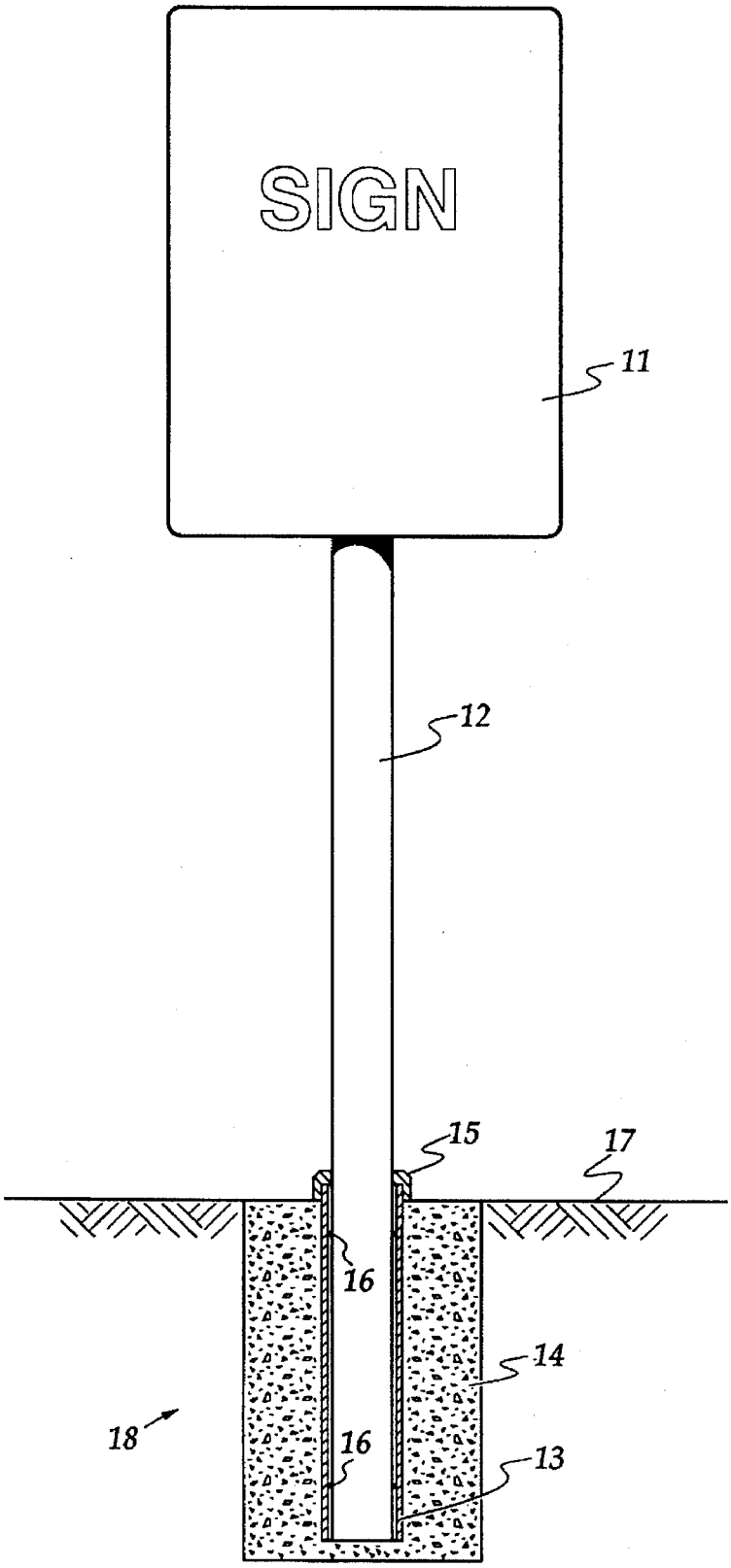
FIG. 1 is a sectional view of a support assembly for a traffic sign.
Figure 2:
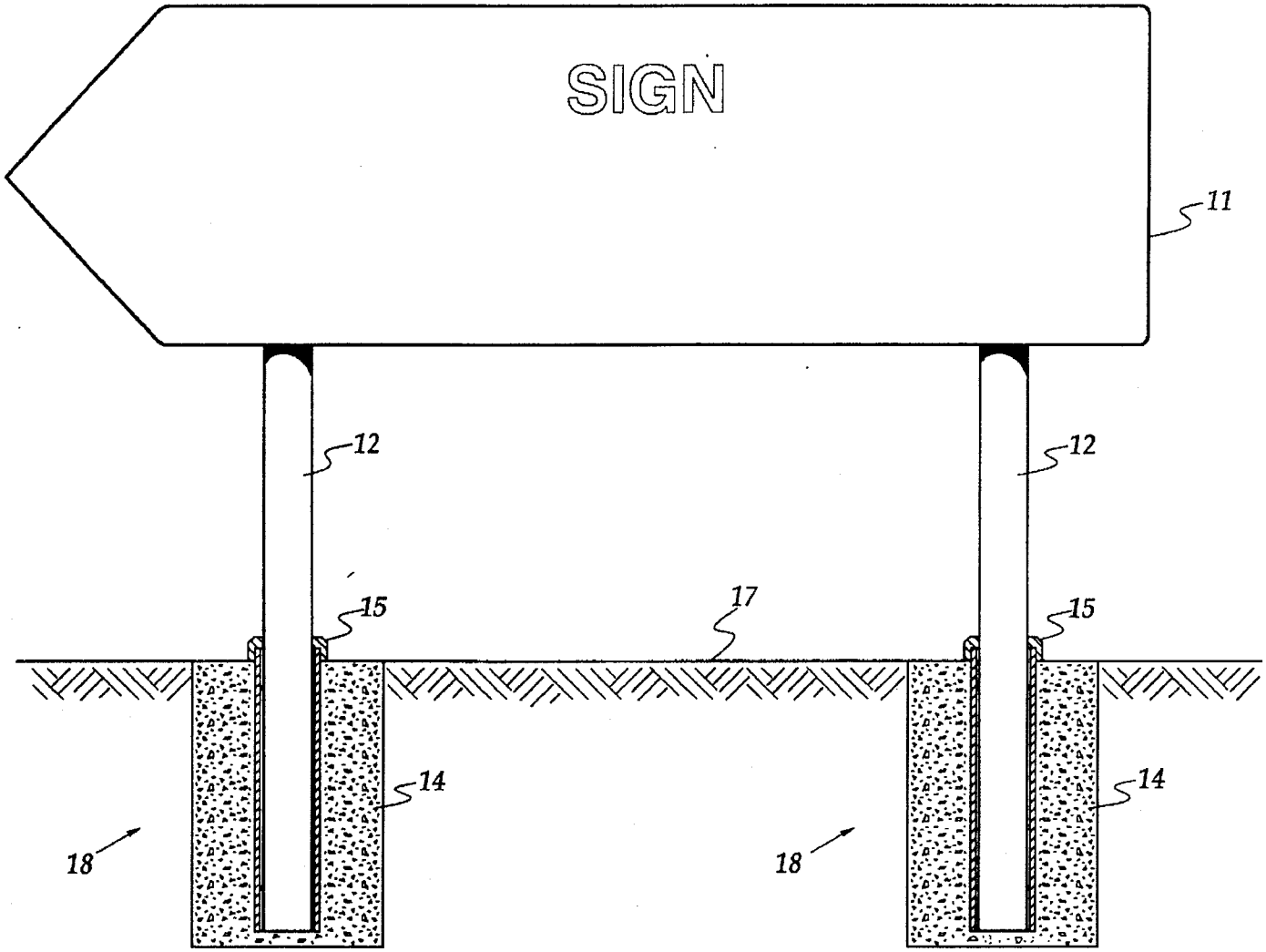
FIG. 2 is a view of a support assembly for a large directional sign.
Figure 3:
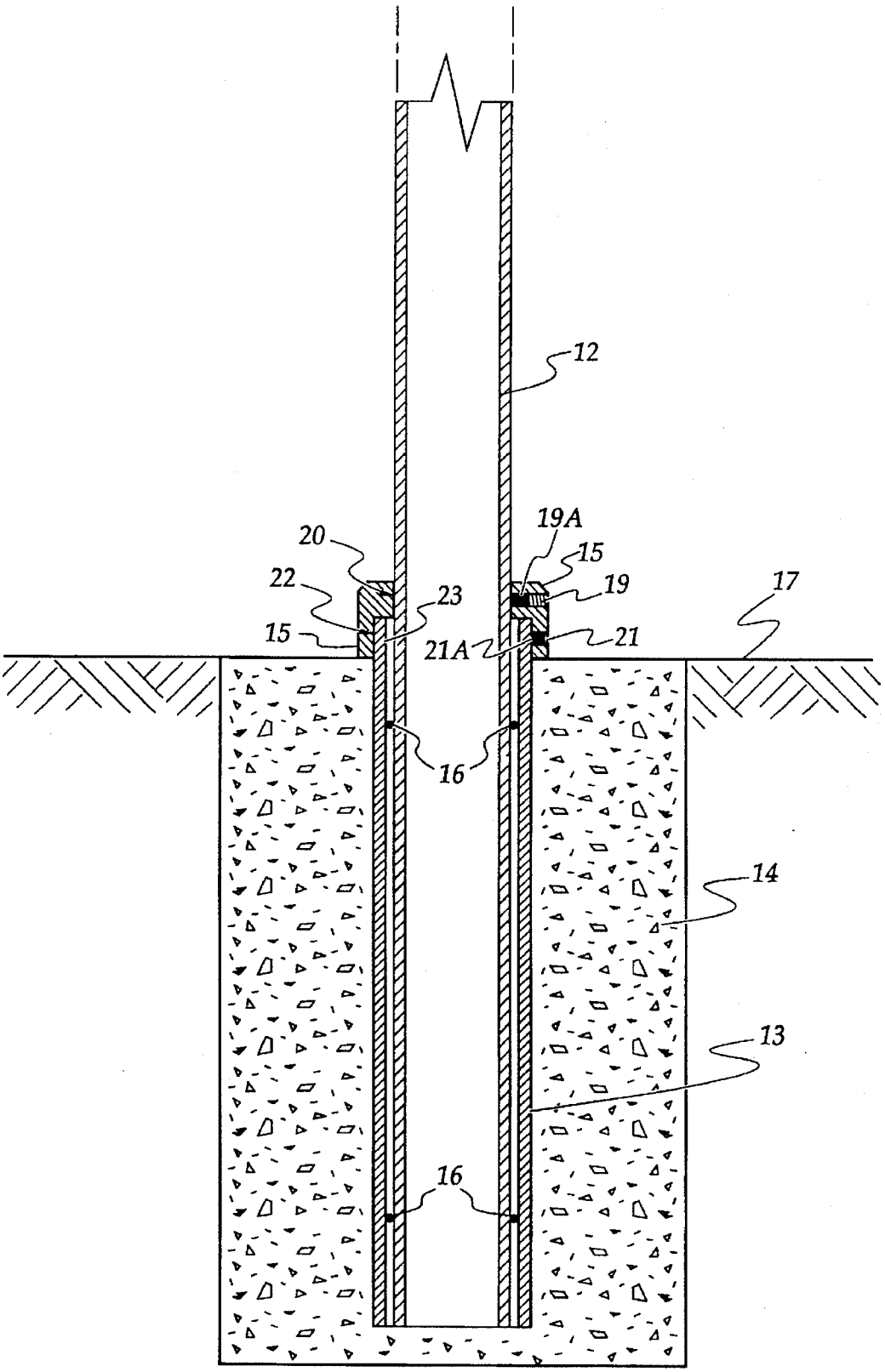
FIG. 3 is a detailed sectional elevation of one embodiment of a support assembly in accordance with the invention.

As can be seen in FIGS. 1 and 2, a sign 11 is attached (by means not shown) to a support post 12 in the form of a hollow galvanised pipe. Support assembly 18 consists of a mounting socket 13 in the form of short length of hollow galvanised pipe set in a concrete pad 14. The mounting socket 13 extends above ground level 17 to form a circumferential lip 23 as illustrated in FIG. 3. The post 12 is spaced from and located within mounting socket 13 by a pair of rubber or neoprene O-rings 16. The outer diameter of post 12 is slightly less than the inner diameter of mounting socket 13.

In use the O-rings are slipped over the lower end of the post 12 and longitudinally separated along its length. Post 12 is then pushed downwardly into mounting socket 13. The O-rings 16 are dimensioned so that their inside diameter is slightly less than the outer diameter of the post 12, and the thickness of O-rings 16 is slightly greater than the difference in radii between the outer diameter of post 12 and the inner diameter of mounting socket 13 so that there can be slight deformation of the O-rings when post 12 is received in mounting socket 12. The O-rings remain spaced in the longitudinal direction during the insertion of post 12 in mounting socket 13 and consequently the post is mounted in stable equilibrium.

Figure 4:
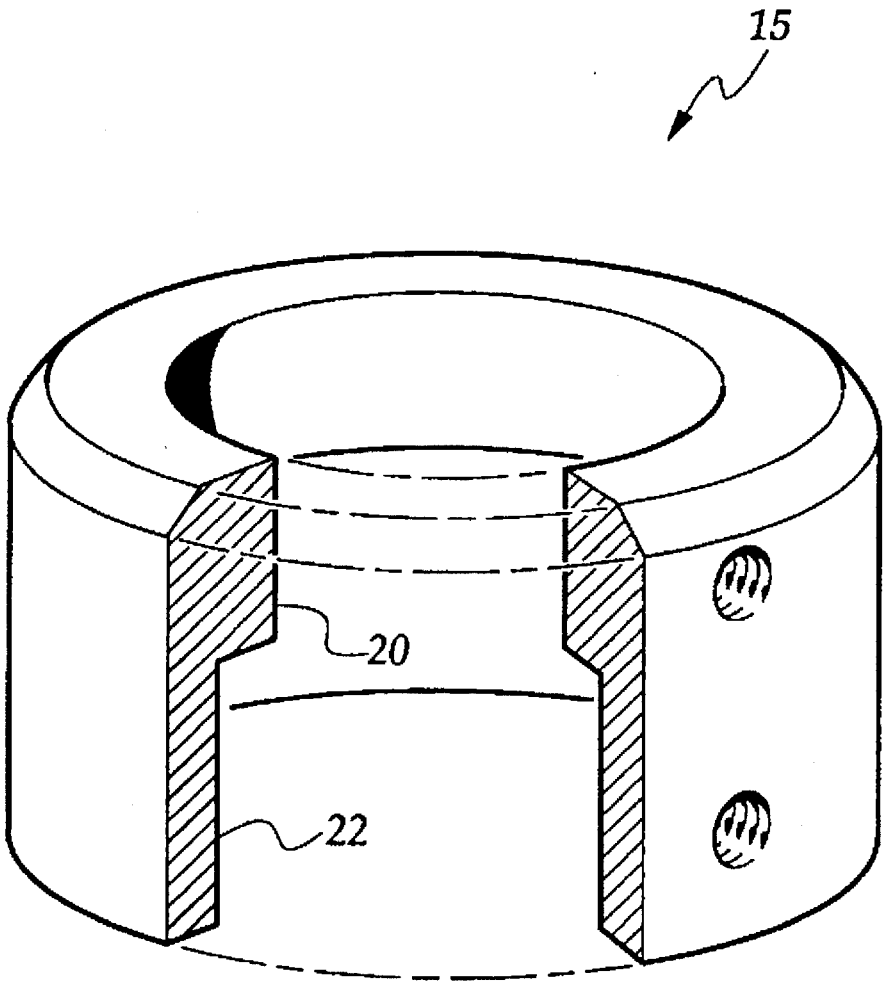
FIG. 4 is a cut-away perspective view of the collar assembly illustrated in FIG. 3.

As illustrated in FIGS. 3 and 4, a stepped cylindrical mild steel collar 15 is positionable at the junction of the post 12 and the mounting socket 13. The inner surfaces of the cylindrical collar 15 are stepped to provide two inner cylindrical surfaces 20 and 22. The diameter of surface 20 is slightly greater than the outer diameter of post 12 and the diameter of surface 22 is slightly greater than the outer diameter of mounting socket 13, whereby collar 15 forms a close tolerance fit about the assembled post and mounting. A typical tolerance for a collar suitable for use with a post made from 50 millimetre nominal bore pipe is approximately 200 microns. If the collar and post are to be painted, a metal-to-metal separation of approximately 800 microns will provide the above tolerance and accommodate a paint coating of up to approximately 200 microns. The depth of inner cylindrical surface 22 is approximately equal to the height of the lip 23. The depth of internal cylindrical surface 20 is approximately one quarter of the diameter of internal cylindrical surface 20. Cylindrical surface 22 constitutes one surface of an annular flange the width of which is approximately twice the thickness of the wall of the hollow cylinder constituting mounting socket 13.

Collar 15 contains a pair of threaded apertures 19 and 21 so that grub screws (19A and 21A) can releasably secure the collar 15 to both post 12 and mounting socket 13 respectively. This arrangement releasably secures post 12 to mounting socket 13 and reduces the likelihood of removal of the post by vandals.

In use, collar 15 is slid over the lower end of post 12 and a pair of O-rings 16 then positioned over the lower end of post 12 and longitudinally separated. The post 12 is then inserted into the mounting socket 13. During insertion the pair of O-rings 16 are compressed and remain longitudinally separated whereby post 12 is co-axially located in mounting socket 13. The collar 15 is then lowered to sit over upper lip 23 of mounting socket 13.

The location of a collar assembly in accordance with this invention as described above, means that upon impact by a motor vehicle, post 12 will bend or crumple above the upper surface of collar assembly 15. Furthermore, neither the collar assembly 15, the lower portion of post 12 within mounting socket 13 nor the lip 23 of mounting socket 13 will be substantially deformed upon impact. The damaged post is thus able to be quickly removed from the mounting socket and a new post quickly replaced.

The absence of substantial deformation described above results from the transverse forces on post 12 during impact being transferred to collar 15 by the close accommodation of post 12 by internal cylindrical surface 20 which thus acts as a reaction face against the impact forces. The forces are transferred to mounting socket 13 because the outer surface of the mounting socket is closely accommodated within cylindrical surface 22 of collar assembly 15.

Cylindrical surface 22 thus constitutes an abutment face which is closely accommodated by lip 23. Collar assembly 15 is thus located against lateral movement by mounting socket 13 but remains removably supported by the mounting socket. Collar 15 is made sufficiently strong so that when impacted by a motor vehicle with sufficient force to bend post 12, it will not be substantially deformed. Thus the width of the annular flange one surface of which constitutes internal cylindrical surface 22 is preferably at least approximately one and a half times the thickness of the wall of the hollow cylinder constituting mounting socket 13, and the depth of internal cylindrical surface 20 is preferably at least approximately one fifth of the diameter of internal cylindrical surface 20. The collar is suitably made from mild steel.

The assembly described above prevents substantial deformation of the lower end of post 12 or of mounting socket 13. Moreover the spacing between post and mounting socket allows for slight deformation or bending of the post without any binding between the post and mounting socket. The uppermost O-ring serves to prevent the ingress of water and moisture. The post and collar assembly thus remain removable from a mounting socket after being impacted by a vehicle with sufficient force to damage the post and necessitate its replacement.

The embodiment described above is particularly suited for use with commercially available piping. Although the internal bore of such piping may be slightly out-of-round and may vary slightly in diameter, the outside diameter and configuration is manufactured to a high tolerance. Consequently the collar of this embodiment, by providing internal surfaces having a high tolerance, can be used to provide a close tolerance fit when commercially available pipe is used in both post and mounting socket. Moreover the above described embodiment enables either light, medium or heavy gauge piping to be utilised in accordance with user preference because the external diameter of all gauges is constant for a given nominal bore.

The details of two examples of collars in accordance with the above preferred embodiment of the invention will now be described. In an assembly for supporting a 50 mm nominal bore light gauge pipe having an outside diameter of 60.3 mm, the mounting socket is made from 65 mm nominal bore medium gauge piping having a wall thickness of 3.6 mm and an outside diameter of 76.1 mm. The width of the annular flange of the collar is 6.55 mm and the depth of the bore supporting the post is 15 mm. In an assembly for supporting a 65 mm nominal bore light gauge pipe having an outside diameter of 76.1 mm, the mounting socket is made from 80 mm nominal bore medium gauge piping having a wall thickness of 4.0 mm and an outside diameter of 88.9 mm. The width of the annular flange of the collar is 10.15 mm and the depth of the bore supporting the post is 15 mm.

Figure 5:
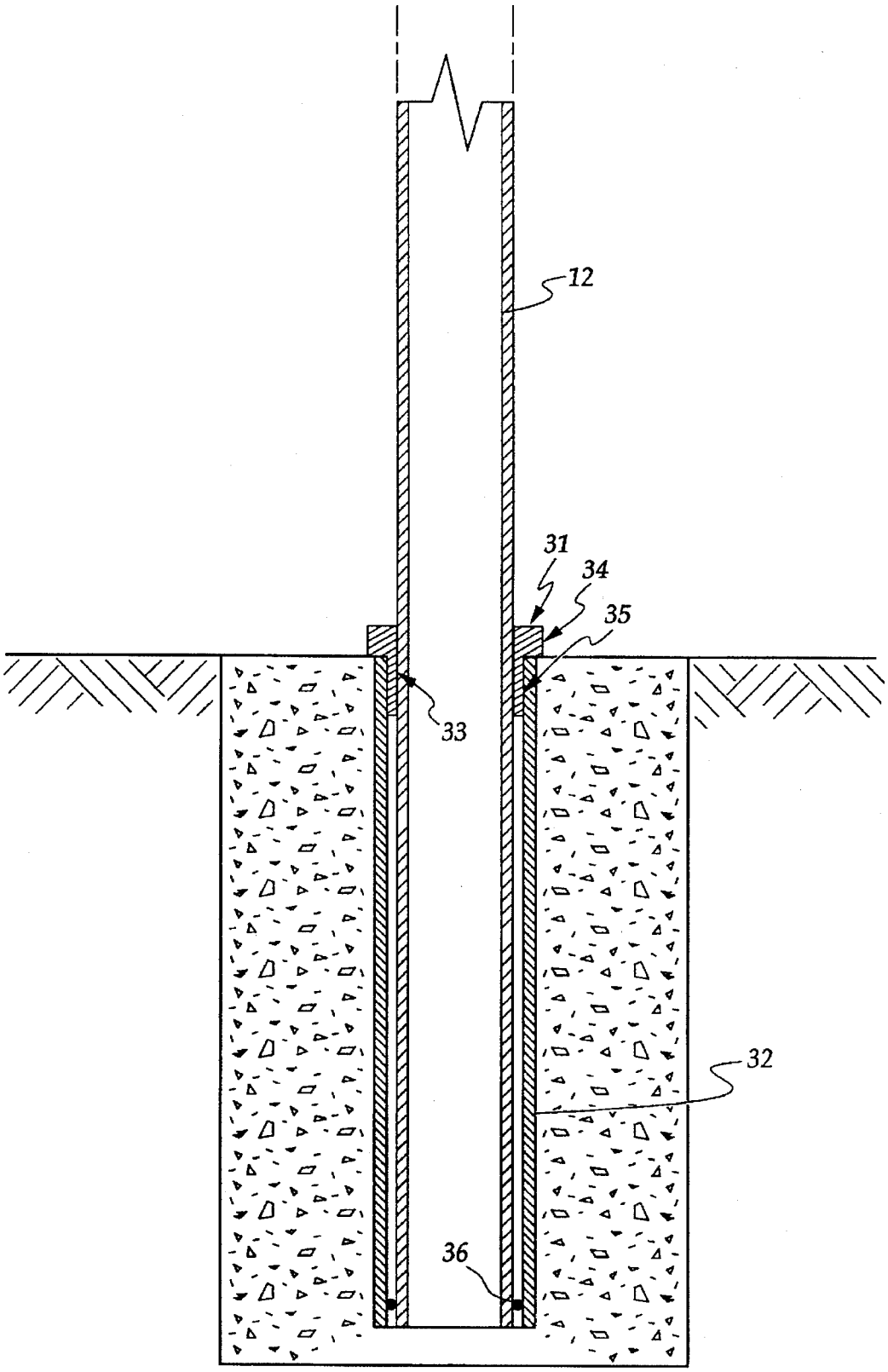
FIG. 5 is a detailed sectional elevation of another embodiment of a support assembly in accordance with the invention.
Figure 6:
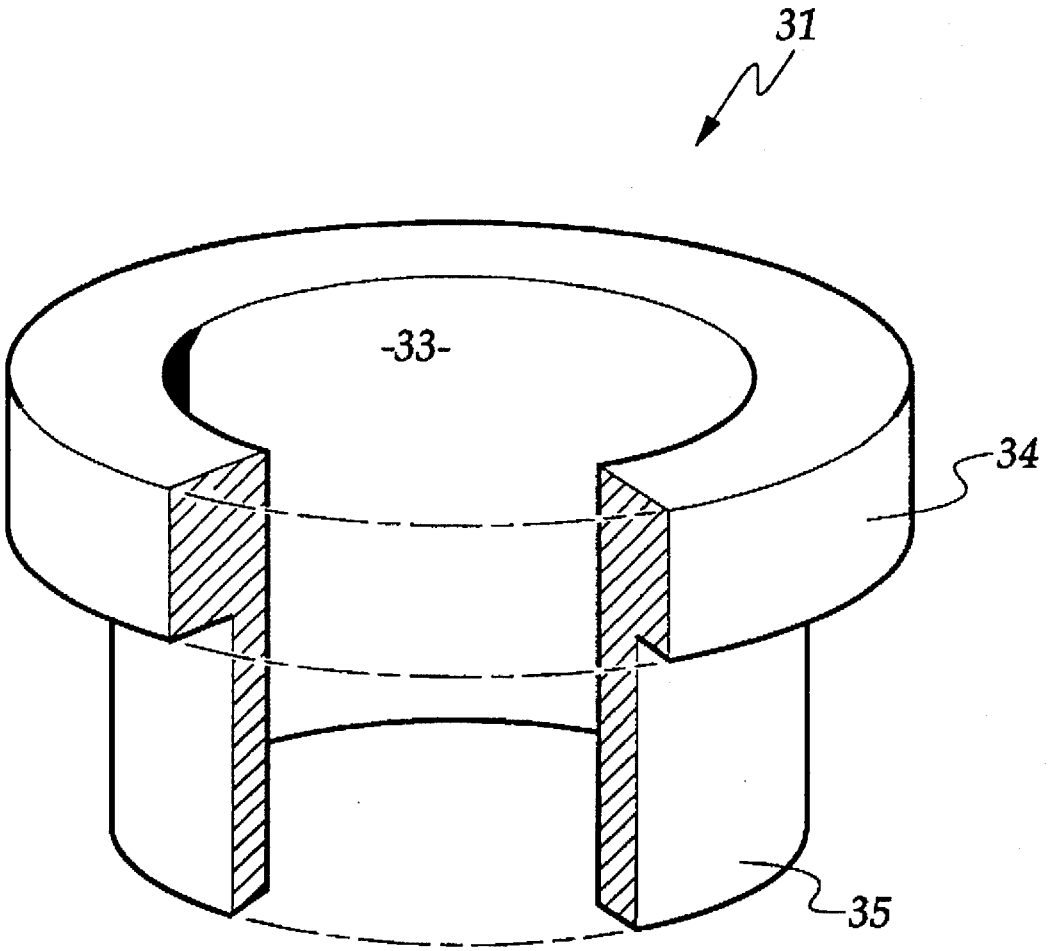
FIG. 6 is a cut-away perspective view of the collar assembly illustrated in FIG. 5.

An alternative embodiment of the collar assembly is illustrated in FIGS. 5 and 6. A stepped cylindrical mild steel collar 31 is positionable at the junction of the post 12 and mounting socket 32. Collar 31 has a bore with an inner cylindrical surface 33. The outer surfaces of collar 31 are stepped to provide two outer cylindrical surfaces 34 and 35. The diameter of surface 33 is slightly greater than the outer diameter of post 12 and the diameter of surface 35 is slightly less than the inner diameter of mounting socket 32 whereby collar 31 forms a close tolerance fit about the post and within the mounting.

Collar 31 may include fastening means (not shown) in similar manner to that described above with reference to FIG. 4 for releasably securing the collar to both post 12 and mounting socket 32. The lower end of post 12 is co-axially located in mounting socket 32 by an O-ring 36 located in the bottom of the mounting socket.

In use, collar 31 prevents substantial deformation in a similar manner to that described above. Collar 31 is slid over the lower end of post 12 and the post is inserted into mounting socket 32. Collar 31 is then lowered to sit on the upper end of mounting socket 32 with cylindrical surface 35 being accommodated within the upper end of mounting socket 32.

As with the previously described embodiment, the absence of substantial deformation results from the transverse forces on post 12 during impact being transferred to collar 31 by the close accommodation of post 12 by internal cylindrical surface 33 which thus acts as a reaction face against the impact forces. The forces are transferred to mounting socket 32 because the inner surface of the mounting socket closely accommodates cylindrical surface 35 of collar assembly 31.

Cylindrical surface 35 of collar assembly 31 thus constitutes an abutment face which is closely accommodated by the inner surface of the upper end of mounting socket 32. Collar assembly 31 is thus located against lateral movement by mounting socket 32 but remains removably supported by the mounting socket. Like collar 15, collar 31 is made sufficiently strong so that when impacted by a motor vehicle with sufficient force to bend post 12, it will not be substantially deformed. Thus the width of the annular flange one surface of which constitutes cylindrical surface 35 is preferably at least approximately one and a half times the thickness of the wall of the hollow cylinder constituting mounting socket 32, and the depth of internal cylindrical surface 33 is preferably at least approximately one fifth of the diameter of internal cylindrical surface 33. The collar is suitably made from mild steel.

In the embodiment described above with reference to FIGS. 4 and 5, mounting socket 32 does not have a lip protruding above the ground. The mounting socket is thus supported by the surrounding concrete pad for the transfer of transverse forces upon impact. Consequently in this embodiment the mounting socket can be made from a suitable light grade material such as extruded PVC piping.

Figure 7:
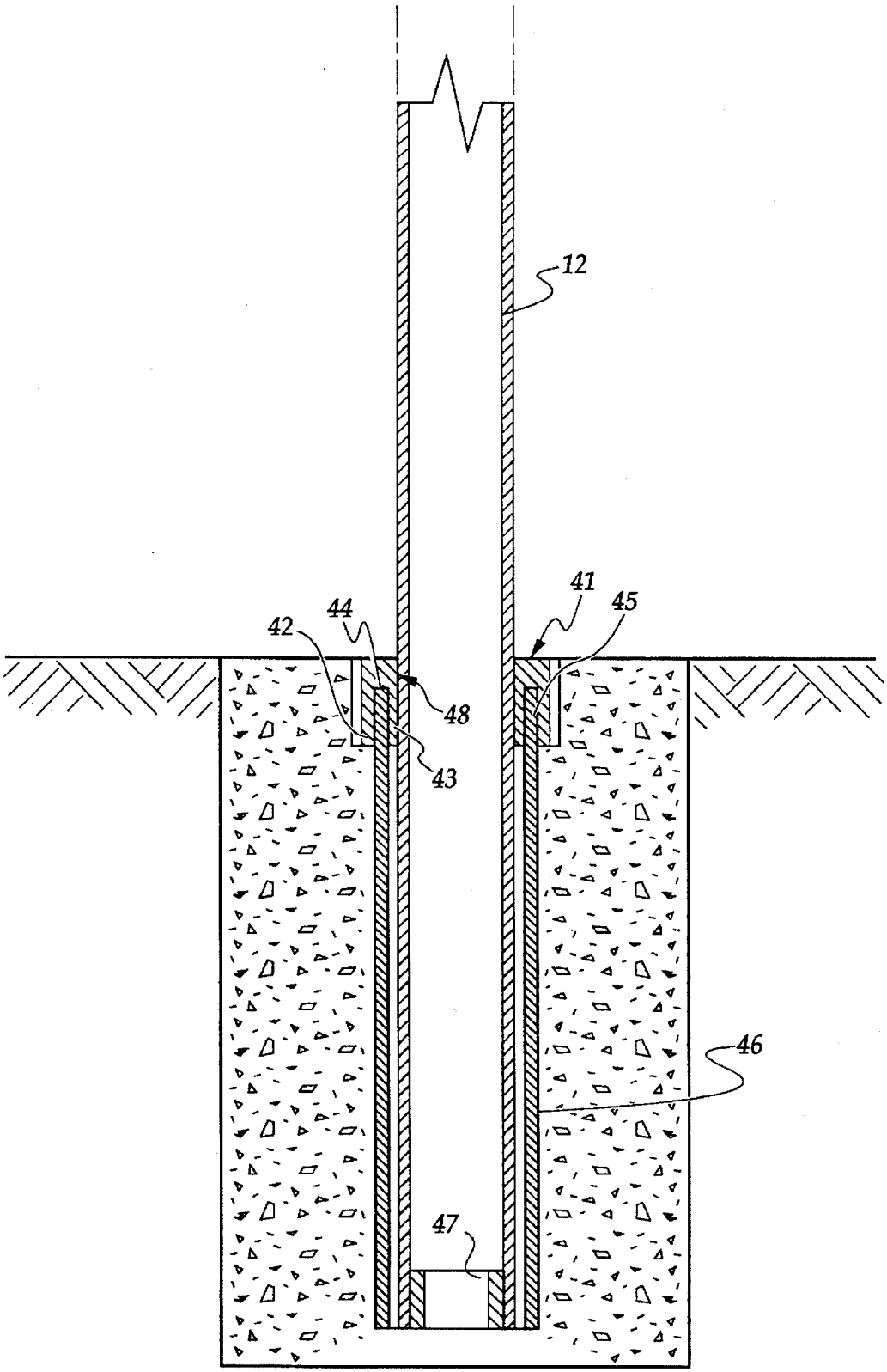
FIG. 7 is a detailed sectional elevation of a further embodiment of a support assembly in accordance with the invention.
Figure 8:
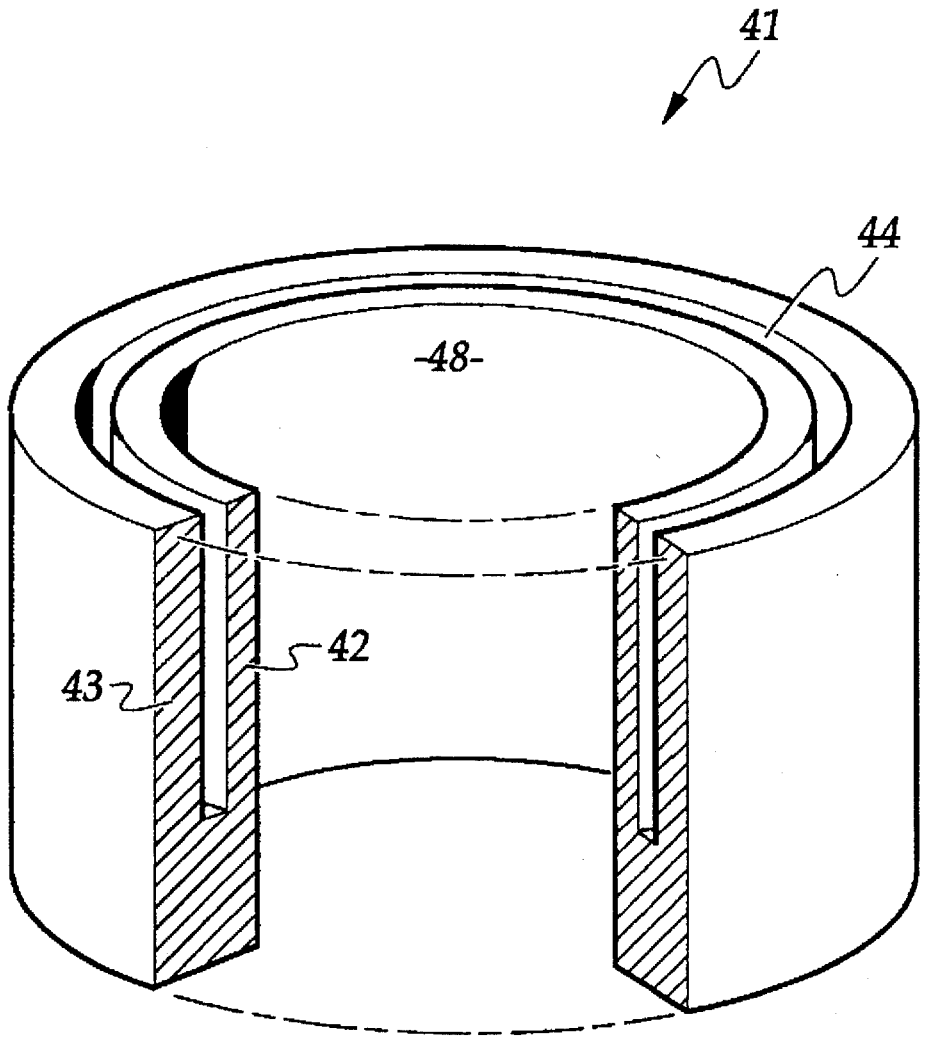
FIG. 8 is a cut-away perspective view of the underside of collar assembly illustrated in FIG. 7.

FIGS. 7 and 8 illustrate another embodiment in which collar 41 has a pair of concentric annular flanges 42 and 43 forming an annular groove 44 adapted to closely receive an upper lip 45 of mounting socket 46. This embodiment incorporates aspects of both previous embodiments such that collar 41 is located against lateral movement by mounting socket 46 by the opposed surfaces of groove 44 which thus constitute abutment faces which closely accommodate upper lip 45 of mounting socket 46. Internal surface 48 acts as a reaction face against impact forces in manner similar to that of the previously described embodiments and the configuration similarly results in an absence of substantial deformation of collar assembly 41, mounting socket 46 or the lower portion of post 12 within mounting socket 46.

Collar 41 may include fastening means (not shown) in similar manner to that described above with reference to FIGS. 3 to 6 for releasably securing the collar to both post 12 and mounting socket 46. The lower end of post 12 is coaxially located in mounting socket by a central spigot 47.

Figure 9:
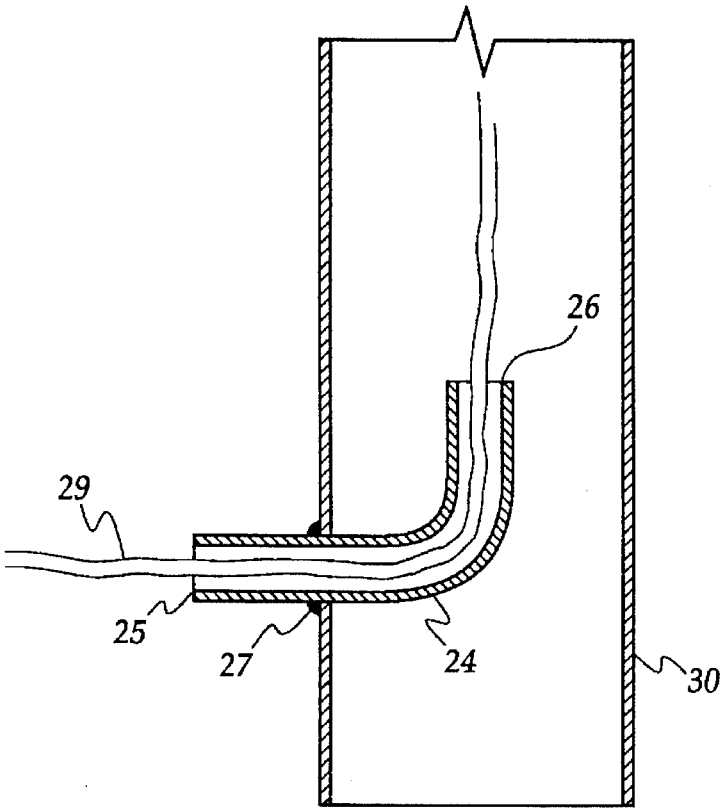
FIG. 9 is a sectional elevation of a mounting socket including a passage for electrical cables.
Figure 10:
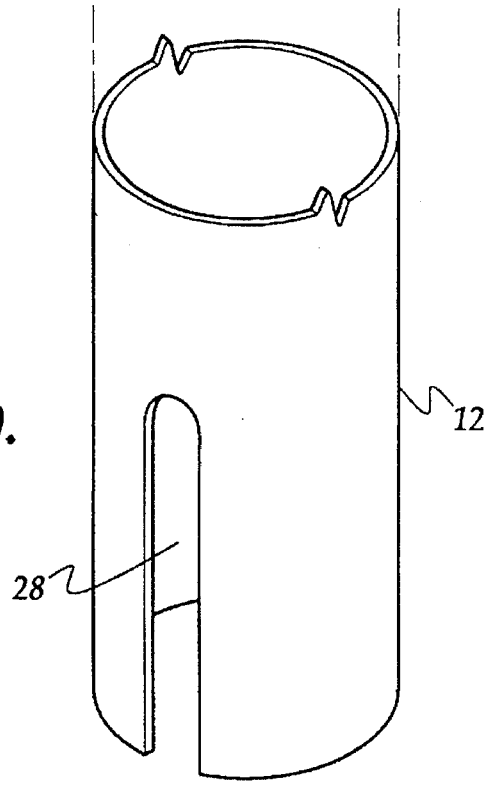
FIG. 10 is a sectional elevation of a post for use with the mounting socket illustrated in FIG. 9.
Figure 11:
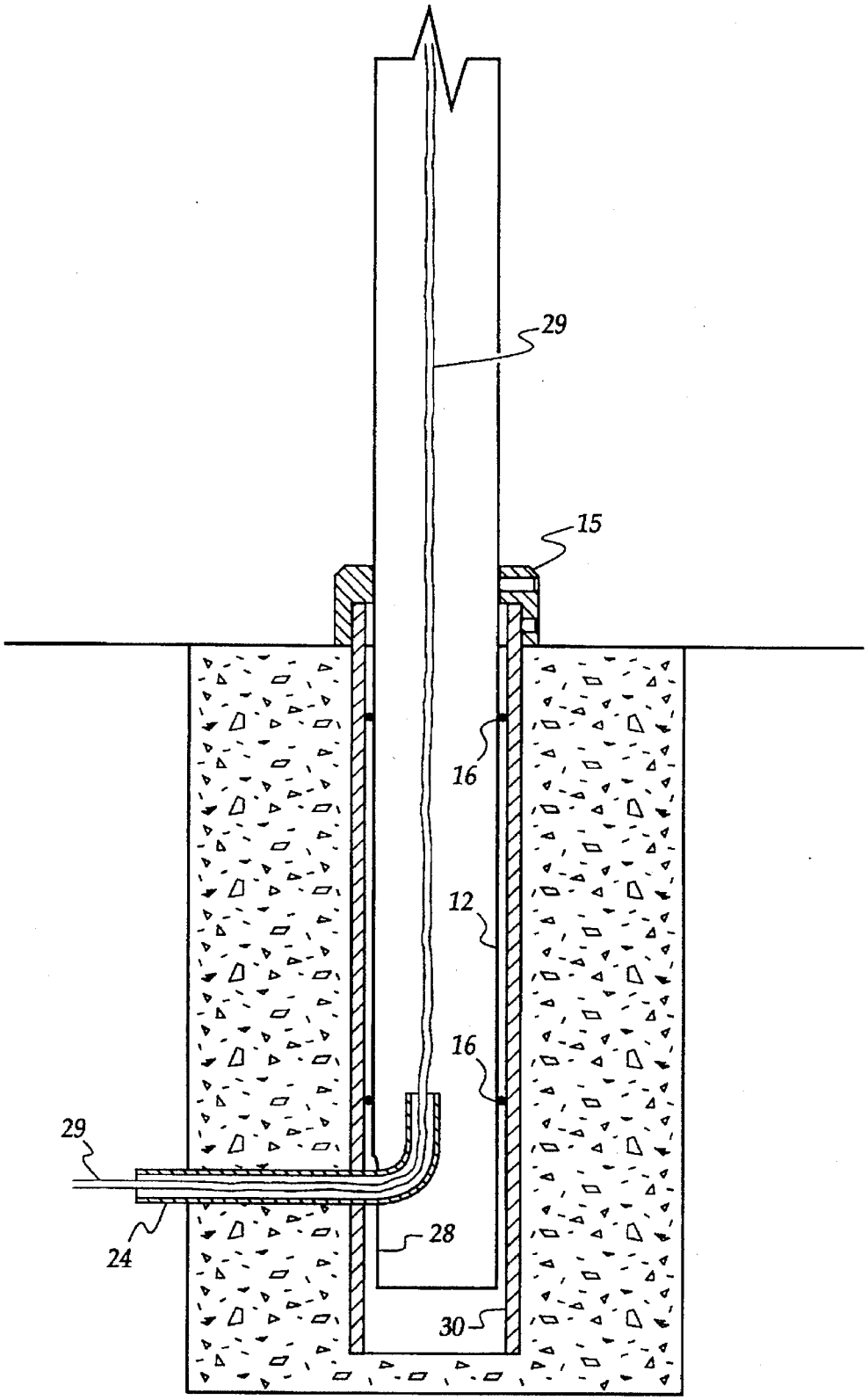
FIG. 11 illustrates an assembled support assembly including a passage for electrical cables.

As can be seen in FIG. 9, the base of a post 12 for traffic lights or street lighting can be modified to provide a slot 28 extending longitudinally upwards from the base of the post. Mounting socket 30 includes a passage in the form of conduit 24 braised or welded as at 27 or otherwise fixed to or integral with the mounting. Conduit 24 extends outwardly of mounting socket 30 to an opening 25 and inwardly of the mounting to an upwardly facing conduit outlet 26. An electrical lead 29 can pass through the conduit as illustrated.

Conduit 24 slides in slot 28 when post 12 is received in mounting 23 as previously described. As is illustrated in FIG. 9, electric lead 29 is protected during the mounting and insertion process. Moreover, the width of slot 28 is only slighter greater than the outer diameter of conduit 24 and the assembly is thus effective to prevent rotation of post 12 within mounting socket 30 when positioned therein.

It will be appreciated that the installation of a pipe in accordance with this system can be easily and quickly accomplished. To remove a damaged post 12, the grub screws are removed and the damaged post removed by applying an upward force. The new post and sign is then positioned as described above. Accordingly labour costs associated with replacing damaged signs can be reduced in comparison with known methods and the likelihood of workmen being injured by passing traffic is correspondingly minimised.

It will of course be realised that whilst the above has been given by way an illustrative example of this invention, all such and other modifications and variations hereto, as would be apparent to persons skilled in the art, are deemed to fall within the broad scope and ambit of this invention as is hereinafter claimed.

I claim:

1. A support assembly for supporting a post in the ground, said support assembly including:

a mounting socket for location in the ground and dimensioned to receive the lower end of a post therein;

a rigid collar assembly in the form of a stepped sleeve having an upper face in use extending radially outwardly from the post and a lower face in use extending radially outwardly of the mounting socket, a socket-engaging reaction face extending upwardly from the lower face and dimensioned to be accommodated in a close tolerance fit by an upper portion of said mounting socket so as to be removably supported thereon and located against lateral movement thereby, and a post-engaging abutment face extending downwardly from the upper face and dimensioned to accommodate a post to be supported by the said support assembly in a close tolerance fit;

the arrangement being such that upon application to a post supported by the support assembly of a substantially transverse load sufficient to bend the post, the rigid collar assembly is not deformed and said close tolerance fits prevent substantial deformation of that portion of the post received within the mounting socket, whereby the post and the collar assembly remain removable from the mounting socket; and locating means interposable between the inner surface of said mounting socket and the outer surface of said post for locating said post co-axially in said mounting socket.

2. A support assembly as claimed in claim 1, wherein said stepped sleeve is a stepped cylindrical sleeve.

3. A support assembly as claimed in claim 2, wherein said stepped cylindrical sleeve has internal cylindrical surfaces constituting said socket-engaging and post-engaging faces.

4. A support assembly as claimed in claim 1, wherein said locating means comprises resilient support means interposable between said post and said mounting socket for releasably supporting said post.

5. A support assembly as claimed in claim 4, wherein said resilient support means are adapted to be longitudinally spaced along said post when said post is received by said mounting socket.

6. A support assembly as claimed in claim 1, wherein said collar assembly includes retention means adapted to releasably secure said collar assembly to at least one of said mounting socket and said post.

7. A support assembly as claimed in claim 1, wherein said mounting socket includes passage means extending from the exterior of said mounting socket to the interior thereof, and receiving means associated with said post for receiving therein the passage means whereby said post may extend into said mounting socket and be restrained against rotational movement relative thereto.

8. A support assembly as claimed in claim 7, wherein said passage means is a conduit adapted to receive electrical cables therethrough.

9. A support assembly as claimed in claim 8, wherein said conduit has an elbow bend in the interior of said mounting socket and said receiving means is a slot extending longitudinally from the lower end of said post and adapted to pass over said conduit when said post is inserted in said mounting socket.

10. A support assembly for supporting a post in the ground, said support assembly including:

a mounting socket for location in the ground and dimensioned to receive the lower end of a post therein;

a rigid collar assembly in the form of a stepped sleeve having a socket-engaging reaction face dimensioned to be accommodated in a close tolerance fit by an upper portion of said mounting socket so as to be removably supported thereon and located against lateral movement thereby, and a post-engaging abutment face dimensioned to accommodate a post to be supported by the said support assembly in a close tolerance fit;

the arrangement being such that upon application to a post supported by the support assembly of a substantially transverse load sufficient to bend the post, the rigid collar assembly is not deformed and said close tolerance fits prevent substantial deformation of that portion of the post received within the mounting socket, whereby the post and the collar assembly remain removable from the mounting socket; and locating means for locating said post co-axially in said mounting socket, said locating means comprising resilient support means interposable between said post and said mounting socket for releasably supporting said post, wherein said resilient support means includes at least one O-ring adapted to be sealingly engaged between said mounting socket and said post.

11. A support assembly as claimed in claim 10, wherein said resilient support means are adapted to be longitudinally spaced along said post when said post is received by said mounting socket.

12. A support assembly as claimed in claim 11, wherein said resilient support means include two O-rings adapted to be sealingly engaged between said mounting socket and said post.

* * * * *